US005954895A

United States Patent [19]

Dumez et al.

[11] Patent Number: 5,954,895

[45] Date of Patent: Sep. 21, 1999

[54] METHOD OF MAKING A DEPOSIT ON A COMPONENT MADE OF A NICKEL OR COBALT BASED SUPERALLOY

[75] Inventors: Marie-Caroline Dumez, Saussines; Jean-Pierre Huchin, Chatellerault; Rose Marie Marin-Ayral, Saint Bres; Didier Perraud, Poitiers; Jean-Claude Tedenac, Montpellier, all of France

[73] Assignee: Societe Sochata, Paris, France

[21] Appl. No.: 08/915,584

[22] Filed: Aug. 21, 1997

[30] Foreign Application Priority Data

Aug. 22, 1996 [FR] France ..... 96 10351

[51] Int. Cl.[6] ..... B22F 7/04

[52] U.S. Cl. ..... 148/515; 148/527; 419/8; 419/68

[58] Field of Search ..... 148/515, 527, 148/537; 419/8, 9, 68

[56] References Cited

U.S. PATENT DOCUMENTS

| | | | |
|---|---|---|---|
| 3,450,512 | 6/1969 | Maxwell | 428/680 |
| 4,219,592 | 8/1980 | Anderson et al. . | |
| 4,614,296 | 9/1986 | Lesgourgues . | |
| 4,705,203 | 11/1987 | McComas et al. . | |
| 4,778,649 | 10/1988 | Niino et al. . | |
| 4,973,366 | 11/1990 | Yasuda et al. | 148/527 |
| 5,330,701 | 7/1994 | Shaw et al. | 419/10 |
| 5,342,539 | 8/1994 | Nagan . | |
| 5,352,539 | 10/1994 | Psiuk | 428/558 |
| 5,837,385 | 11/1998 | Schaeffer et al. | 148/537 |

FOREIGN PATENT DOCUMENTS

| | | |
|---|---|---|
| 0 531 083 | 3/1993 | European Pat. Off. . |
| 0 574 290 | 12/1993 | European Pat. Off. . |
| 1.552.850 | 1/1969 | France . |
| 2 397 259 | 2/1979 | France . |
| 2 511 908 | 3/1983 | France . |
| 507341 | 6/1939 | United Kingdom . |
| 796531 | 6/1958 | United Kingdom . |

OTHER PUBLICATIONS

Patent Abstracts of Japan, vol. 4, No. 129 (c–024), Sep. 10, 1980 & JP 55 082762 Jun. 21, 1980 p. 1.

*Primary Examiner*—George Wyszomierski
*Attorney, Agent, or Firm*—Oblon, Spivak, McClelland, Maier & Neustadt, P.C.

[57] ABSTRACT

A method of making a deposit on a component made of a nickel or cobalt based superalloy is described wherein a deposit material consisting of reactive powders corresponding to an intermetallic material or of a superalloy powder is deposited on the component before placing it in a chamber and subjecting it to a neutral gas at a hydrostatic pressure of up to 1.5 GPa, the chamber being provided with heater means for producing a controlled temperature of up to 1200° C. at a rate of increase of from 5° C. to 120° C. per minute and a thermal gradient of 200° C. between the ends of the component, and the temperature and pressure conditions in the chamber are selected such that the deposit material undergoes a synthesis reaction by self-propagated combustion under high pressure so as to obtain densification of the deposit and a metallurgical bonding between the deposit and the component.

7 Claims, 9 Drawing Sheets

METHOD OF MAKING A DEPOSIT ON A COMPONENT MADE OF A NICKEL OR COBALT BASED SUPERALLOY

BACKGROUND OF THE INVENTION

1.Field of the Invention

The present invention relates to a method of making a deposit on a turbomachine component made of a nickel or cobalt based superalloy.

2.Summary of the Prior Art

It is known in many situations to improve the working life of a component by applying a coating to a localized region of the component so as to improve its surface properties in this region as a function of specific stresses or contacts. Examples of surface treatment techniques of this type are described in FR-A-2397259, which proposes depositing, by fusion welding, a layer of crack-resistant alloy at the tip of a blade and then a layer of an alloy which is hard and/or resistant to oxidation corrosion. Also known from FR-A-2511908 is a diffusion-brazing assembly process for adding an element to a component made of a nickel or cobalt based superalloy, the element being in the form of a presintered blank made from a mixture of two powders, one of which, called the deposit powder, represents between 5 and 25% by weight of the mixture and comprises a nickel, chromium and boron base or a nickel, cobalt, silicon and boron base. Furthermore, US-A-4705203 describes a process for repairing surface defects in superalloy components which involves plasma flame spraying of two successive layers of different compositions and then a heat treatment during which only the first layer is melted and the surface layer is subsequently withdrawn.

The manufacturing technique described in FR-A-2511908 makes it necessary to use a homogenous mixture of powders to prepare an autobrazable sintered material which is used to form a deposit by brazing on a localized region of a superalloy component. In this case the maximum temperature at which the superalloy component is subsequently used must remain substantially lower than the brazing temperature.

Research has also been carried out to develop processes for the synthesis of either metallic, intermetallic or ceramic materials by self-propagated combustion. For example US-A-4778649 describes a process for the manufacture of a composite material in which a copper alloy layer is covered by a powder mixture layer of Ti+B+Cu, and a reaction in which $TiB_2$ is synthesized by self-propagated combustion is triggered by compression and heating. A $TiB_2$ surface layer and an intermediate layer of a $TiB_2$+Cu mixture are thus obtained on a copper substrate. Zr or Al, as well as other borides or carbides can also be used.

SUMMARY OF THE INVENTION

It is an object of the invention to provide a method of making a deposit on a component made of a nickel or cobalt based superalloy which is applicable to the restoration or coating of turbomachine components made of a nickel or cobalt based superalloy exhibiting either a polycrystalline structure, a structure obtained by directed solidification, or a monocrystalline structure, and which does not suffer from the disadvantages of the existing methods.

Accordingly, the invention provides a method of making a deposit on a component made of a nickel or cobalt based superalloy, comprising the steps of:

(a) depositing an element made of a deposit material on at least one localized region of the component, said deposit material being selected from the group consisting of powders which are reactive in proportions corresponding to the formation of an intermetallic material and nickel or cobalt based superalloy powders;

(b) placing the component bearing the element deposited in step (a) in a high-pressure chamber provided with means for feeding and compressing a neutral gas to obtain a neutral gas atmosphere in said chamber at a hydrostatic pressure of up to 1.5 GPa, heater means for achieving a temperature of up to 1200° C. in said chamber at a rate of increase of between 5° C. per minute and 120° C. per minute while ensuring a thermal gradient of 200° C. from one end to the other of said localized region of the component, and measuring means for controlling the temperatures in said chamber; and (c) operating said heater means and said neutral gas feeding and compressing means to obtain predetermined conditions of temperature and pressure in said chamber whereby said element of deposit material undergoes a synthesis reaction by self-propagated combustion under high hydrostatic pressure of said neutral gas so as to obtain densification of the deposit and a metallurgical bonding between the deposit and the superalloy component in said localized region thereof.

Other characteristics and advantages of the invention will become apparent from the following description of the preferred embodiments of the invention, with reference to the attached drawings.

DESCRIPTION OF THE PREFERRED EMBODIMENTS AND EXAMPLES

The apparatus employed for carrying out the method in accordance with the invention comprises a high-pressure chamber which can be supplied with a neutral or inert gas by a compression system and which also forms a furnace, being provided with a heating system and a temperature measuring system.

In one embodiment the gas compressor employed consists of three compression stages connected in series so that the gas is compressed successively. The final gas pressure reached is 1.5 GPa and a pressure gauge allows the gas pressure utilized to be controlled.

The high-pressure chamber is constructed in a manner which is suited to the conditions of use at high pressures and temperatures, such as with multiple walls inserted within a frame and comprising a water-cooled enclosure as well as all the necessary access, electrical connections, gas passages and sealing arrangements. Equipment for applying a vacuum of the order of 1 Pa is also provided, and a rotational facility allows the chamber to be used in a horizontal, vertical or inclined position.

The heating system consists of a heater element in the form of a graphite loop and two graphite electrodes placed at each end to form a furnace in the said chamber. Adjustments make it possible to achieve a thermal gradient of the order of 200° C. over a component placed in the furnace. Thermocouples are used to obtain temperature measurements.

Other arrangements can be incorporated into the apparatus. In particular, energy input equipment can be added for initiating the reaction, such as a tungsten filament, a graphite filament or a laser beam.

EXAMPLE 1

A deposit is effected on a component made of a nickel-based superalloy A in order to restore the desired profile by refilling with the aid of a mixture of nickel and aluminum powders in equiatomic proportions.

Figure 1:
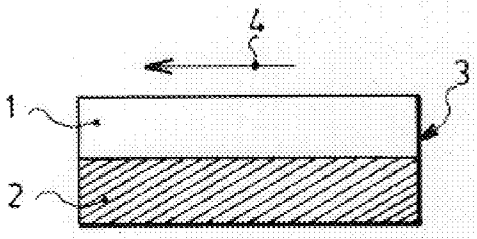
FIG. 1 shows a diagrammatic sectional view of a deposit element placed on a substrate in one embodiment of the method in accordance with the invention.

The nickel and aluminum powders employed have a particle size smaller than 150$\mu$m. In the present example, step (a) of the method of forming the deposit on the superalloy component comprises placing a dense element 1 made from the nickel and aluminum powders on the region of the component to be restored, which forms a substrate 2, as shown diagrammatically in FIG. 1. The dense element 1 is formed beforehand in two preliminary substages comprising the production of a homogenous mixture of a suitable quantity of nickel and aluminum powders, and cold compaction of the mixture obtained in a suitable mould under a load of 40 MPa.

Known methods of cleaning the substrate 2 are used before placing the element 1 on the component, which, depending on whether the component is in a newish or worn state, may comprise degreasing, sandblasting and chemical and/or thermochemical deoxidation operations.

In an alternative embodiment the element 1 may be formed, depending on the application, by an injection moulding technique which is known per se.

When the element 1 is placed on the substrate 2 it is possible to ensure that it remains in position by applying, for example, a capacitor discharge to the element.

Other known techniques may be used for depositing the deposit material on the substrate, such as direct deposition of the powders on the substrate 2 in an electrophoretic environment.

The next step (b) of the method involves introducing the component comprising the element 1 on the substrate 2 into the high pressure furnace chamber and filling the chamber with a neutral gas at a high hydrostatic pressure.

In the final step (c) a synthesis reaction is carried out on the element 1 in the chamber so as to ensure its densification and the production of a metallurgical bond between the element 1 and the surface of the substrate 2 defined by the component. A refilling is thus effected by deposition of material onto the desired region of the component. The synthesis reaction, which in this example leads to the formation of a Ni–Al intermetallic compound, is initiated at one end 3 of the element 1 when a triggering temperature is reached, which in this case is 673° C. An exothermic self-propagated combustion reaction then progresses in the direction of the arrow 4 shown in FIG. 1 until the opposite end 5 is reached. The conditions observed in this example are as follows:

- the pressure of the inert gas atmosphere in the chamber, consisting of argon in this example, is 146 MPa;
- the temperature in the chamber is increased at 50° C. per minute up to 300° C., then held at 300° C. for 6 minutes, then increased at 90° C. per minute up to 800° C.; the chamber is subsequently cooled at 50° C. per minute to 20° C.

Figure 2:
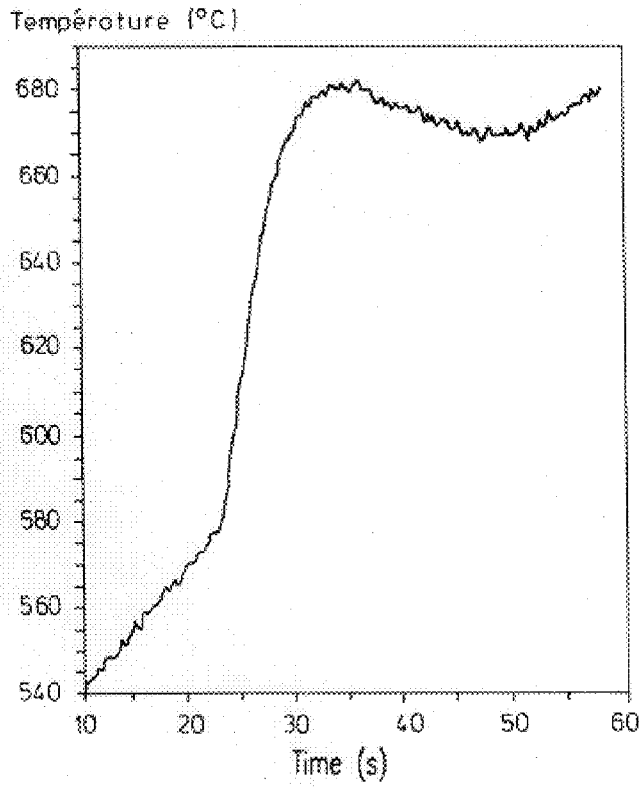
FIG. 2 is a diagram plotting temperature against time during a reaction synthesis by self-propagated combustion in said embodiment.

The diagram in FIG. 2 shows the temperatures measured on the component and shows the initiation of the autocombustion reaction at about 673° C. It will be noted furthermore that the propagation of a combustion front across the material of the element 1 is very fast as soon as the initiation of the reaction is obtained by virtue of the temperature gradient of 200° C. established between the two ends of the said element 1. In this example the reaction is complete and the speed of propagation of the combustion front can be estimated at 20 mm/s. In general the speed of propagation of the reaction lies between 1 and 10 cm per second, depending on the operating conditions applied.

The results described below are taken from a component refilled by a method in accordance with the invention as just described.

When observed macroscopically, the deposit material 1 exhibits a macroporosity with good adherence over the whole length of the region of the component 2 covered by the deposit.

Figure 3:
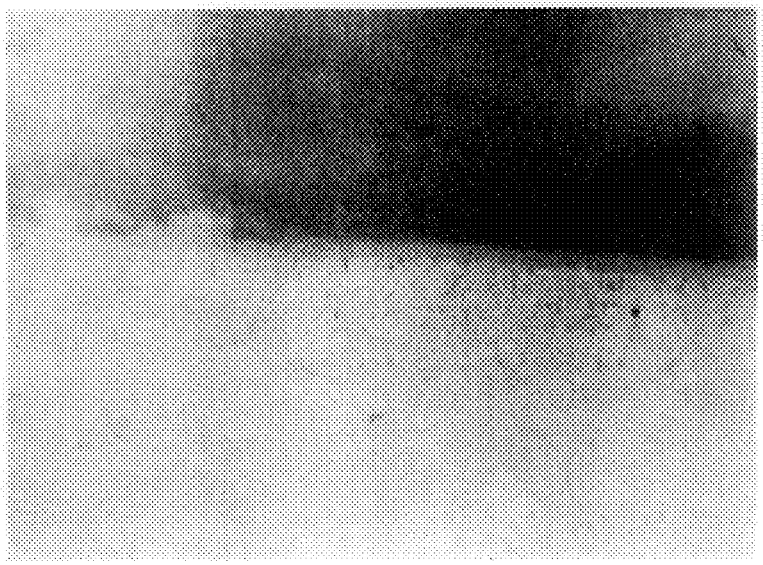
FIG. 3 shows a photomicrograph, at a magnification of 20, of a region of the component comprising the deposit produced in said embodiment.

When observed by optical microscopy, as shown in FIG. 3, an intermediate phase is seen between the material A of the substrate and the intermetallic NiAl material of the deposit. The NiAl material is porous but the portion in contact with the material A is completely densified over a thickness of approximately 0.7 mm.

In observations using scanning electron microscopy two different analyses have been performed, one qualitative, and the other quantitative using an EDS probe.

Figure 4:
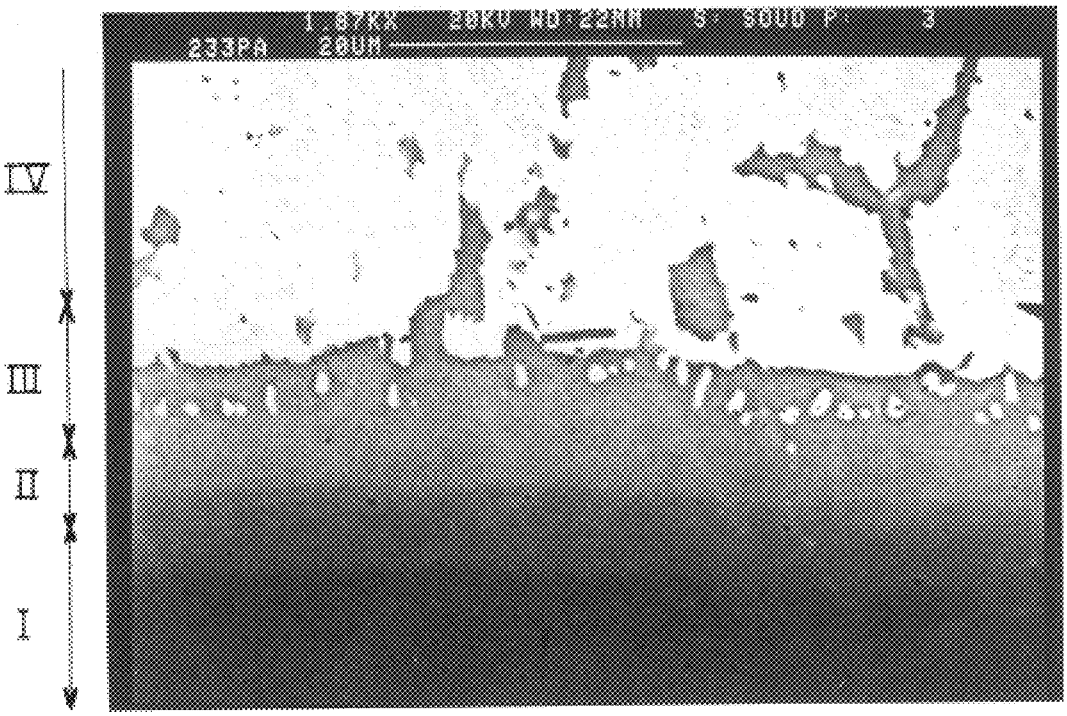
FIG. 4 is a photomicrograph showing the appearance of the material across the junction between the deposit and the substrate of the component.
Figure 5:
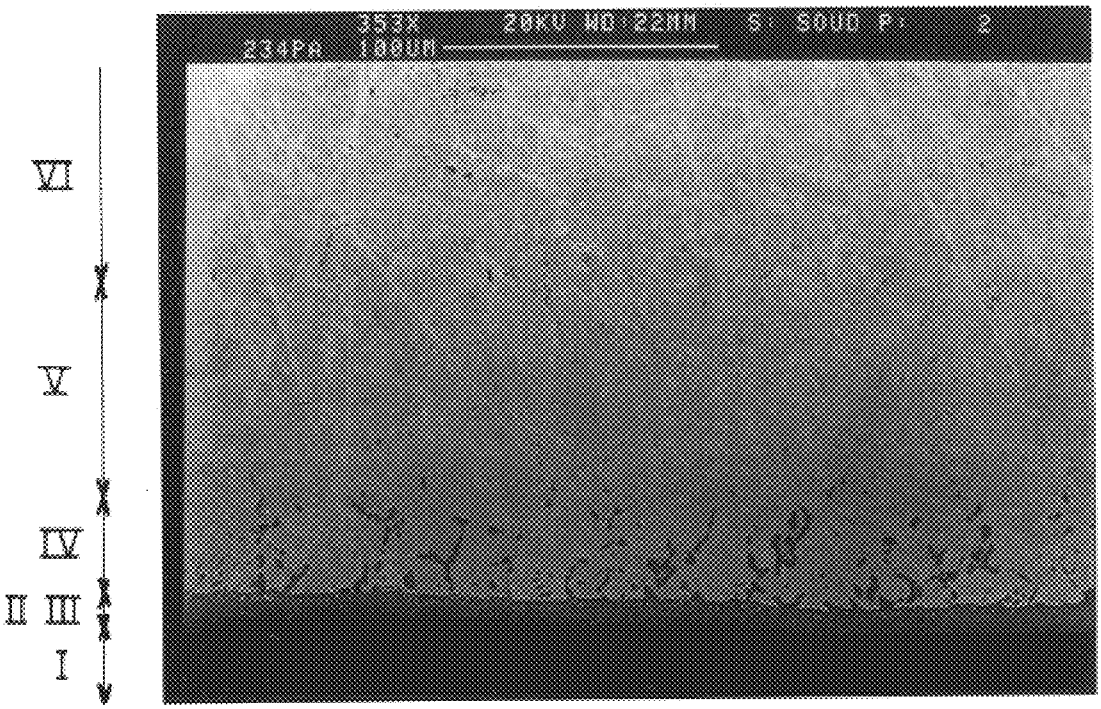
FIG. 5 is a photomicrograph similar to FIG. 4 but to a smaller scale so as to show more of the substrate.

The qualitative analysis allows the intermediate phase between the material A and the NiAl material to be demonstrated. FIGS. 4 and 5 represent photomicrographs showing the appearance of the material obtained. Six regions are distinguished:

I : NiAl

II : NiAl+Co, Cr

III : intermediate phase

IV : region of precipitates

V : material A near the intermediate phase

VI : material A

The table below shows the atomic percentages of the different elements of which the material consists, the accuracy of the measurements carried out being ±1%. The composition of the reference material A is shown in the first column and the results of point analyses carried out in the six regions are reported in the columns which follow.

| | A | REGION VI | REGION V | REGION IV | REGION III | REGION II | REGION I |
|---|---|---|---|---|---|---|---|
| Al | 2.89 | 2.60 | 6.32 | 13.97 | 31.61 | 42.71 | 49.56 |
| Ti | 3.73 | 3.70 | 3.36 | 2.79 | 1.90 | | |
| Cr | 22.32 | 22.40 | 22.30 | 15.56 | 6.82 | 0.75 | |
| Co | 11.95 | 11.90 | 11.81 | 8.18 | 4.51 | 1.09 | |
| Ni | 56.40 | 56.50 | 53.52 | 57.78 | 54.59 | 55.45 | 50.44 |
| Mo | 2.63 | 2.70 | 2.67 | 1.72 | 0.58 | | |
| W | 0.08 | 0.06 | 0.02 | 0.02 | | | |

Figure 6:
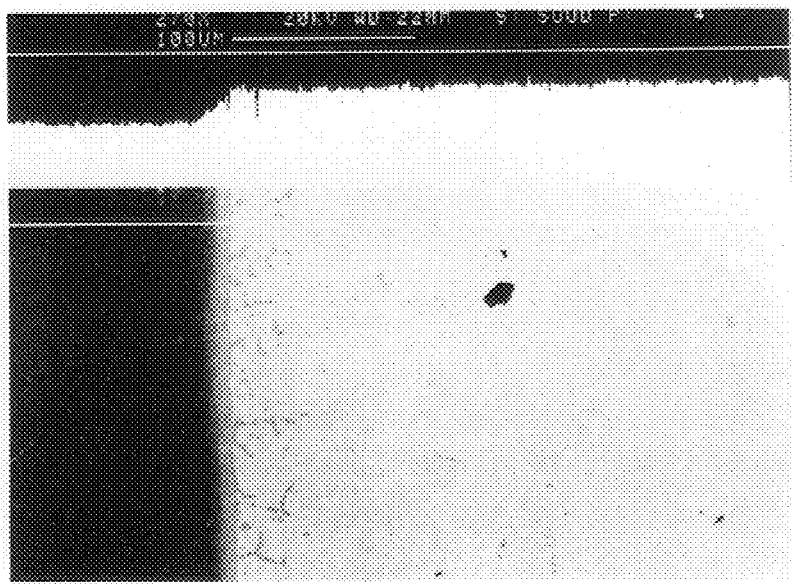
FIG. 6 shows a photomicrograph corresponding to FIG. 5 together with plots indicating the concentration profiles of the constituent elements across the intermediate-phase region between the deposit and the component substrate.
Figure 6:
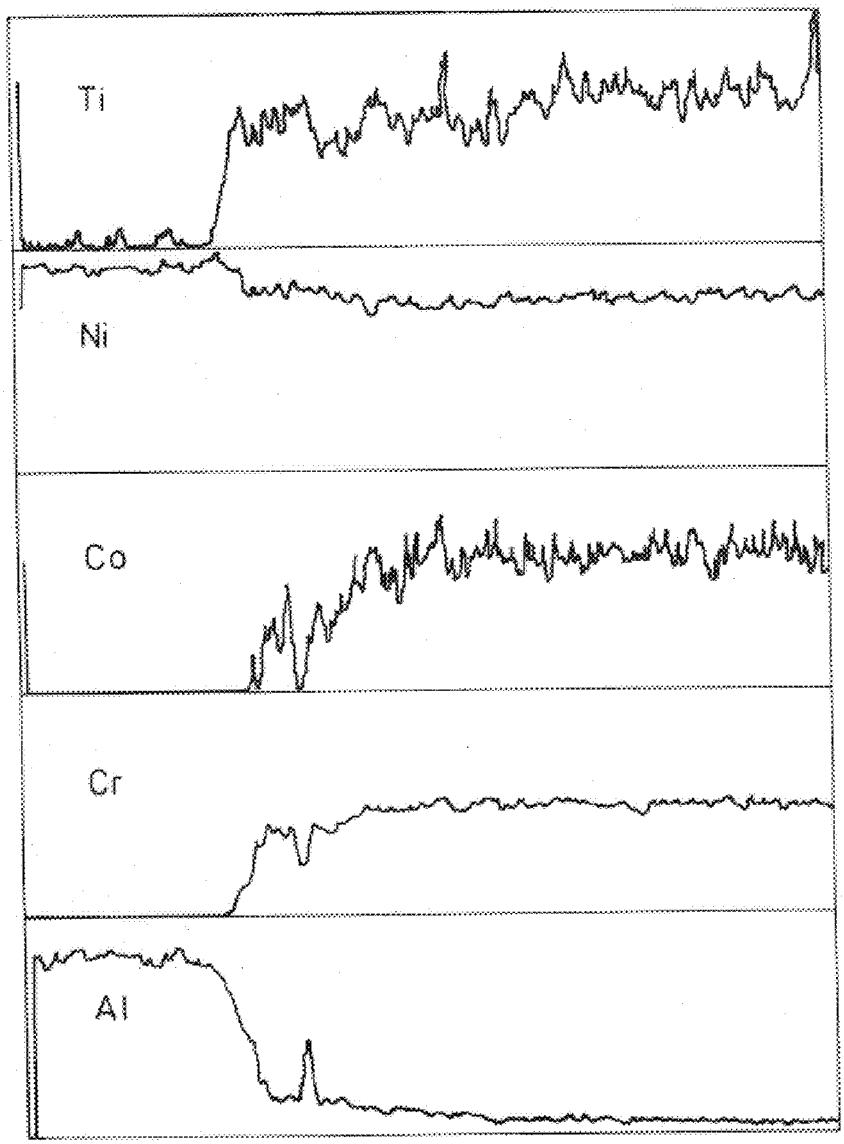
Figure 7:
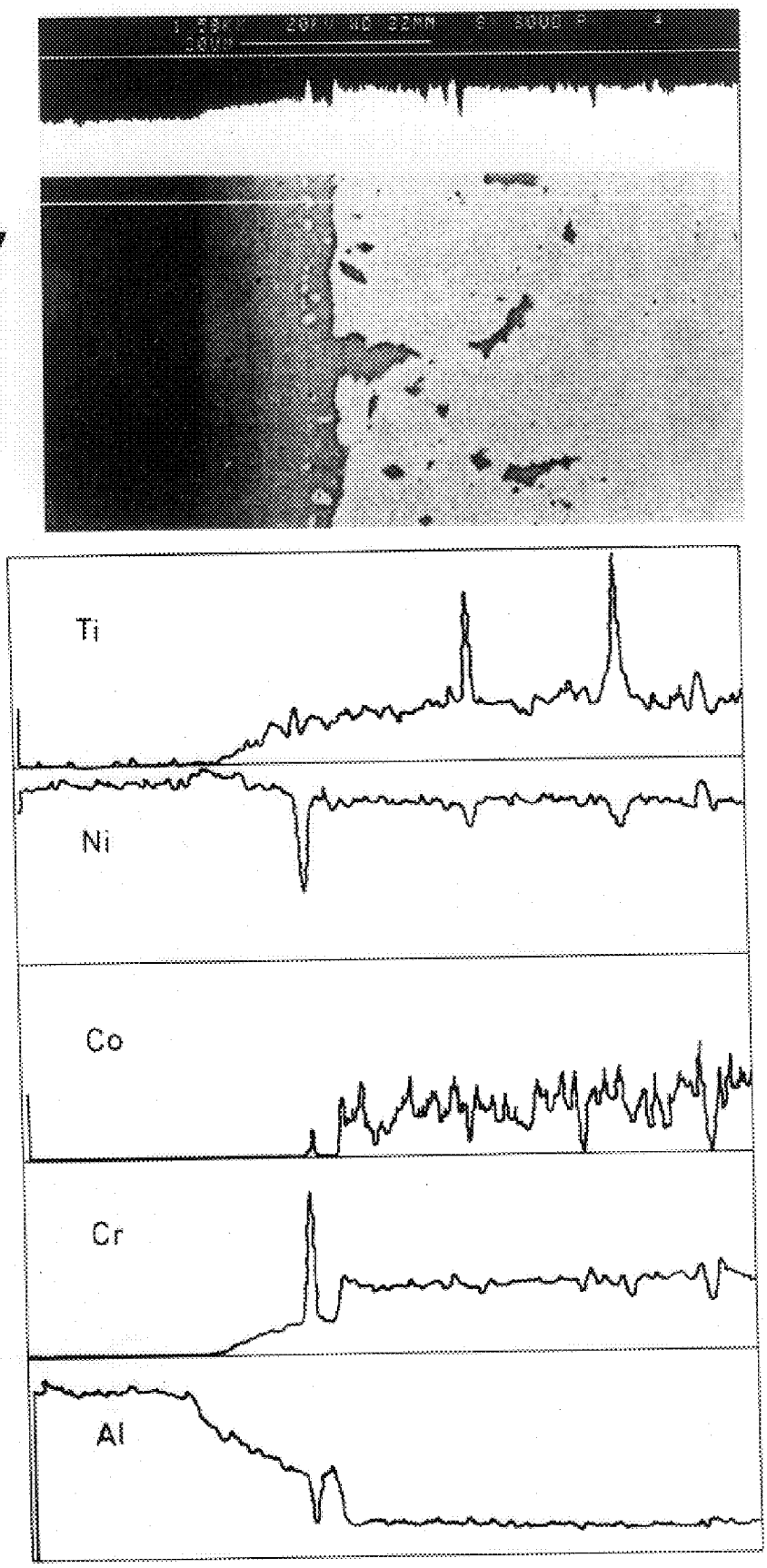
FIG. 7 is a view similar to FIG. 6 but corresponding to the photomicrograph of FIG. 4.

FIGS. 6 and 7 show the change in the concentration of each of the elements Al, Ni, Co, Cr and Ti across the intermediate phase between the material A and the NiAl material. A steady decrease in the aluminum concentration is seen on moving from NiAl to A, associated with an increase in the Cr, Co and Ti concentrations. The finding from this is that a diffusion reaction between the two materials A and NiAl has taken place, the thickness of the intermediate phase reaching approximately 20 $\mu$m (see regions II and III in FIG. 4).

Microhardness tests carried out on the three materials A, NiAl and the intermediate phase using the Vickers method gave the following results:

| | | |
|---|---|---|
| in Region I, | under 100 g load | 252 |
| in Region III, | under 300 g load | 410 |
| in Redion VI, | under 100 g load | 298 |

From these observations it follows that the intermediate phase obtained consists of a solid solution which is continuous between the material A and the NiAl material. No intermediate intermetallic compound has been observed. The introduction of chromium into the NiAl phase may explain the increase in hardness of the intermediate phase in region III due to a solid solution effect, but the hardness level confirms the absence of a complex intermetallic phase.

EXAMPLE 2

A deposit is made on a component made of a nickel-based superalloy B in order to restore the desired profile of the component by refilling with the aid of a mixture of nickel and aluminum powders in equiatomic proportions and the interposition of an intermediate layer made of a nickel-based superalloy C.

Figure 8:
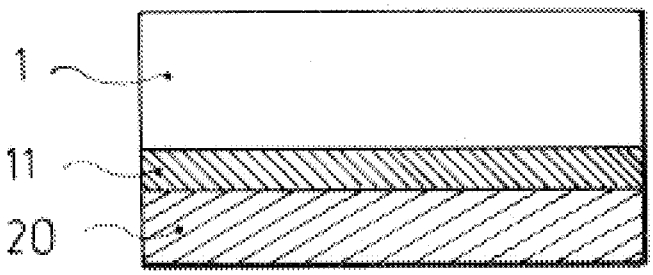
FIG. 8 shows a diagrammatic sectional view similar to that of FIG. 1, but illustrating a deposit element placed on a substrate in another embodiment of the method in accordance with the invention.

As shown diagrammatically in FIG. 8, in step (a) of the method of making the deposit the intermediate layer is formed by a dense element 11 which is placed on the substrate 20 formed by the region of the component which is to be restored, and a dense element 1 formed from the nickel and aluminum powders is placed on the element 11. The element 1 is identical to that which has been described previously in example 1 and is formed in the same way. The intermediate element 11 is formed by sintering powders of the nickel-based superalloy C. The compositions of the superalloys B & C are as follows, in weight percentages: Superalloy B:Cr 14, Co 9.5, Mo 4, Al 3, W 4, Ti 5, Si 0.2, Mn 0.2, C 0.17, and Ni as the remainder. Superalloy C:Co from 16.5 to 19, Cr from 10.4 to 12.2, Mo from 3.3 to 4.2, Al from 2.85 to 3.15, Ti from 2.45 to 2.8, Si from 1 to 1.3, B from 0.68 to 0.8, C from 0 to 0.06; and Ni as the remainder.

The component carrying the intermediate layer element 11 and the deposit layer element 1 is then placed in a high pressure furnace chamber and the chamber filled with a neutral gas at a high hydrostatic pressure.

A synthesis reaction is then carried out on the element 1 in the chamber so as to obtain a densified deposit of material which is metallurgically bonded to the substrate region of the component.

The conditions observed in carrying out the reaction are as follows:

the pressure of the neutral gas atmosphere in the chamber, consisting of argon in this example, is 110 MPa;

the temperature in the chamber is increased at 50° C. per minute up to 300° C., then held at 300° C. for 6 minutes before being increased again at 90° C. per minute up to 600° C.; the chamber is subsequently cooled at 50° C. per minute to 20° C.

The results described below are taken from a component refilled by a method in accordance with the invention as just described.

When observed macroscopically, the combination of the three parts, i.e. the substrate 20 and deposited elements 1 and 11, appears complete and firm.

Figure 9:
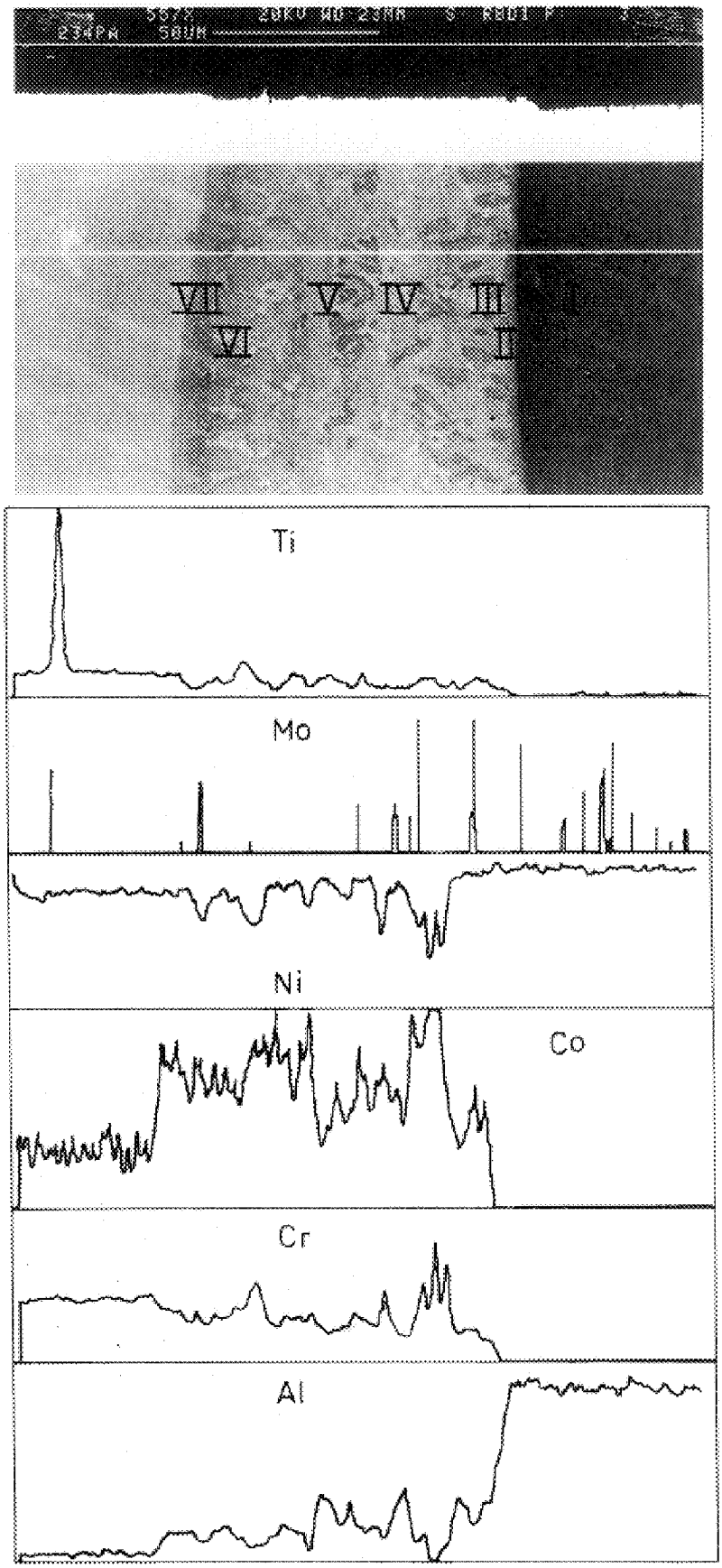
FIG. 9 shows a photomicrograph and plots illustrating the concentration profiles of the constituent elements in the region of the deposit produced on the substrate in the second embodiment.

The scanning electron photomicrograph shown in FIG. 9 indicates the appearance of the material obtained. Seven regions are identified and concentration profiles of the most important of the constituent elements of the material along the line 12 through the material are shown below the photomicrograph.

Figure 10:
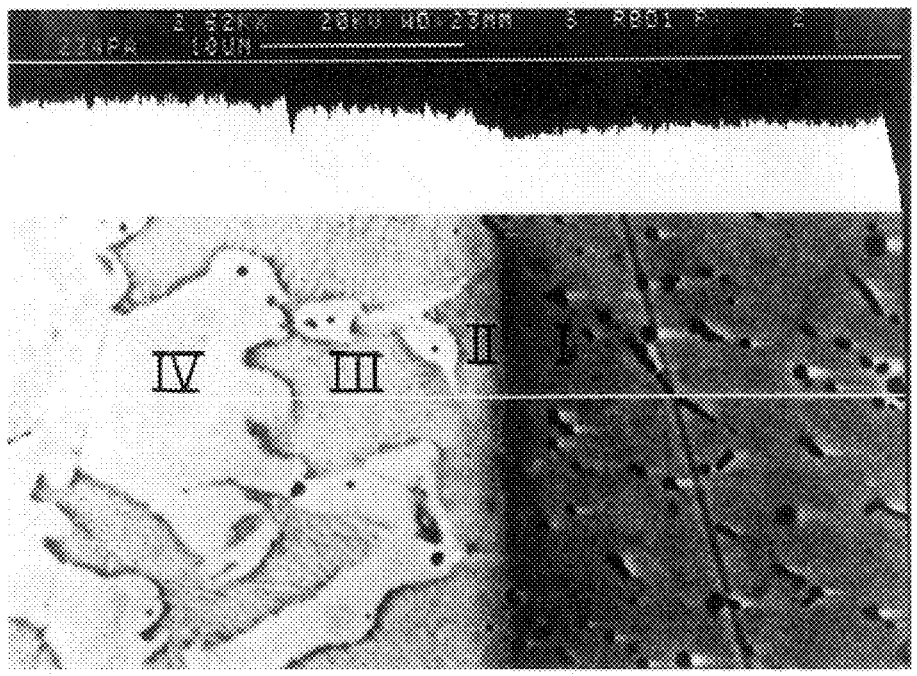
FIG. 10 is an enlarged photomicrograph showing a detail of the deposit region shown in FIG. 9.
Figure 11:
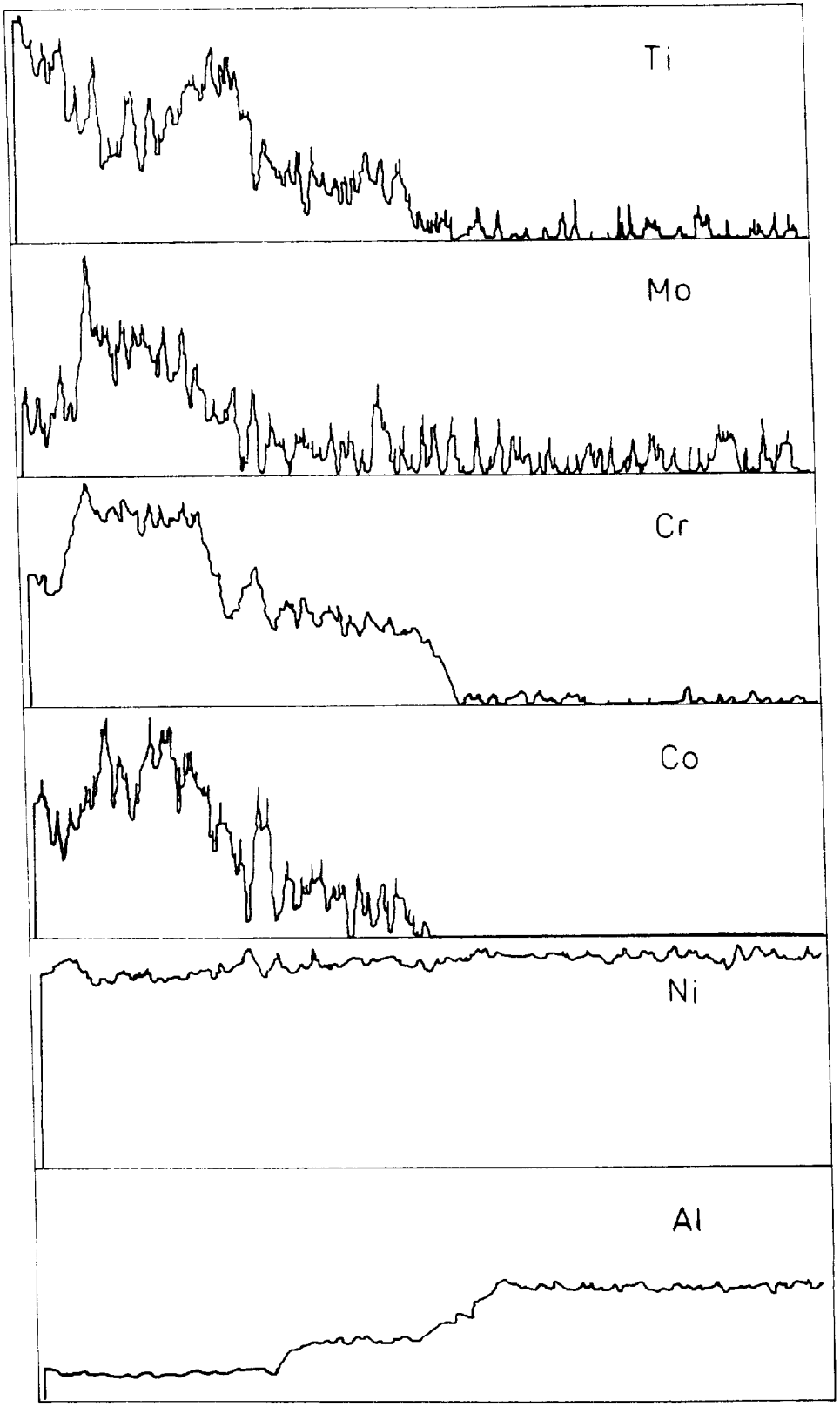
FIG. 11 shows the concentration profiles of the constituent elements in the region shown in FIG. 10.

Region I corresponds to the NiAl intermetallic material. Region II can be seen more clearly in the enlarged photomicrographic detail shown in FIG. 10 and corresponds to the interface between the NiAl material and the superalloy C. The concentration profiles of the elements Al, Ni, Co, Cr, Mo and Ti in this region II are shown in FIG. 11. The homogeneous band of region II corresponds to the diffusion of aluminum and of chromium in particular, also with a variation in the titanium concentration.

Figure 12:
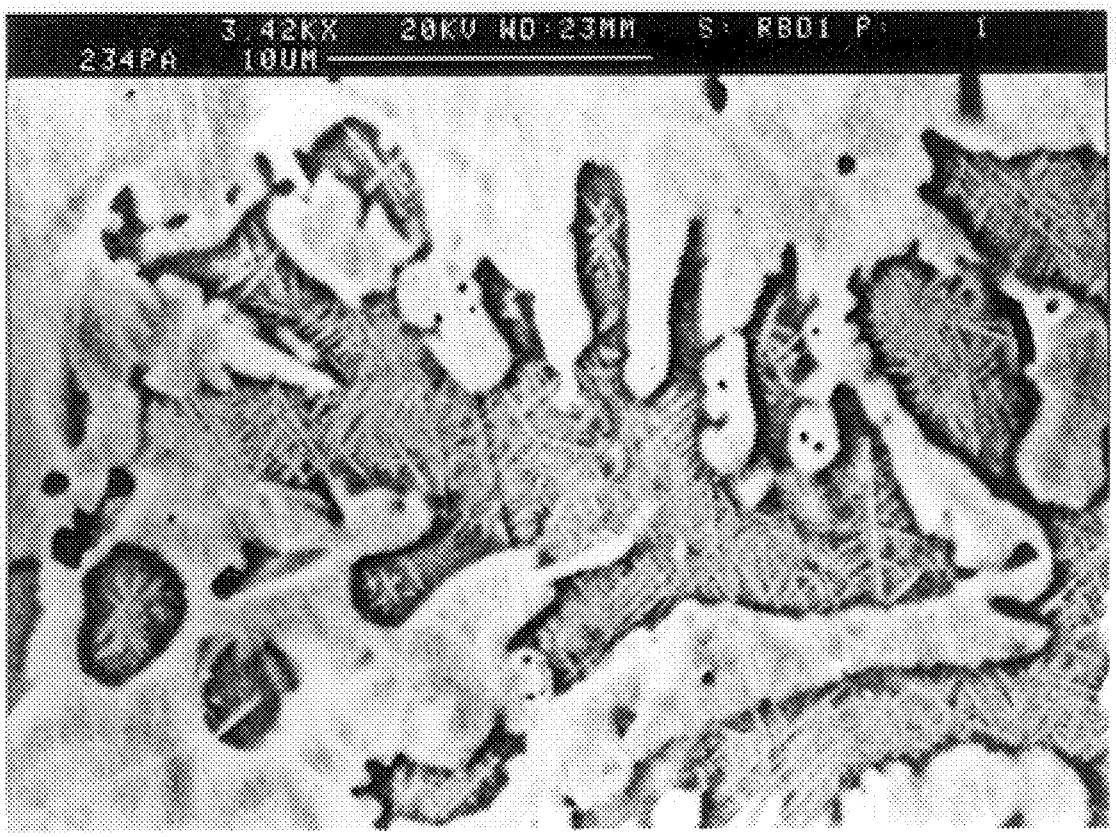
FIG. 12 is an enlarged photomicrograph showing a detail of the region shown in FIG. 10.

In region III the Al, Ni, Co and Mo concentrations are constant, while the Cr and Ti concentrations vary continuously. In the photomicrograph of an enlarged portion of this region III shown in FIG. 12, the polyphasic nature of this region can be seen, with a predominant white-coloured single-phase region and a region of acicular structure. Region IV exhibits a composition close to that of the superalloy C with the presence of light-coloured inclusions corresponding to a few changes in the case of some elements, in particular molybdenum and chromium.

Figure 13:
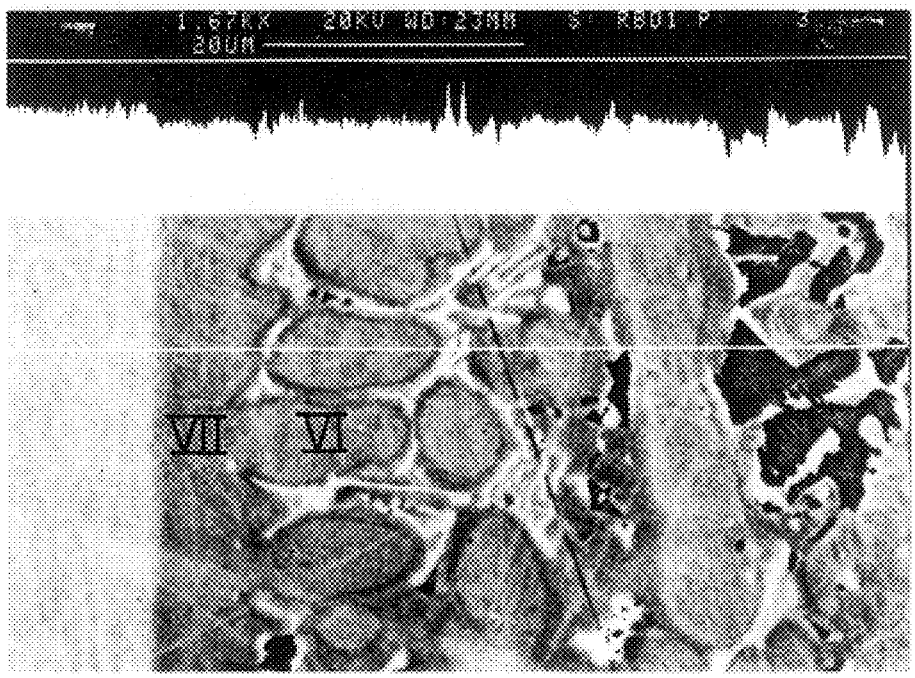
FIG. 13 is an enlarged photomicrograph showing a detail of the region shown in FIG. 9, close to the region shown in FIG. 10; and, FIG. 14 shows the concentration profiles of the constituent elements in the region shown in FIG. 13.
Figure 14:
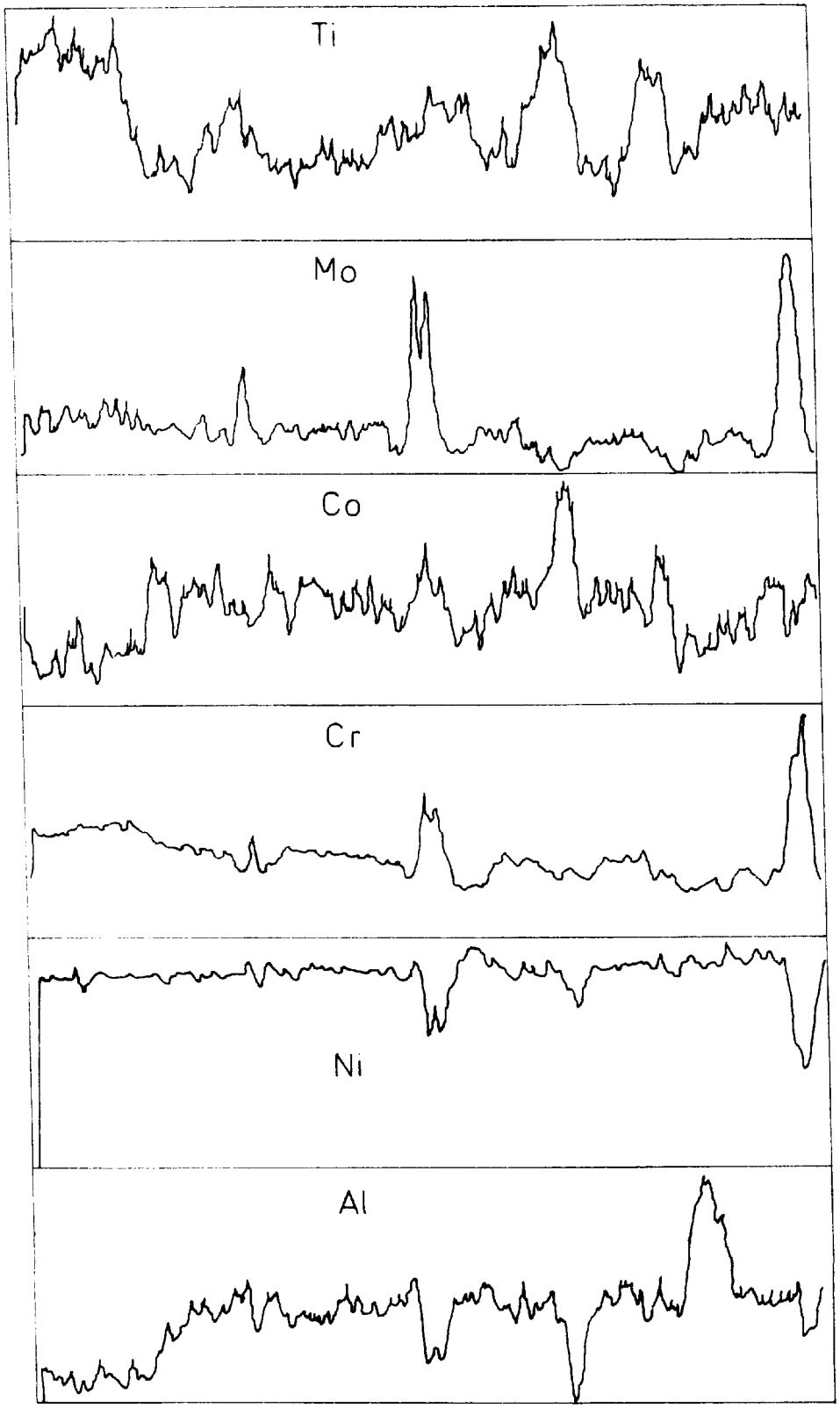

The regions V, VI and VII correspond to the interface between the superalloys C and B. An enlarged detail is shown in the photomicrograph of FIG. 13, and FIG. 14 shows the concentration profiles of the various elements in these regions. Region VI exhibits an average composition close to that of the superalloy C with more aluminum and tungsten but less cobalt and silicon. This region exhibits good homogeneity, the concentrations all being substantially constant. An acicular structure of eutectic type can be distinguished around the grains constituting phase VI, indicating partial melting at the grain boundaries of phase VII. The profiles indicate that this constituent contains Cr, Mo, Ti and Co with less Ni and Al than in the superalloy C. In region VII the aluminum concentration decreases, whereas the chromium and molybdenum concentrations increase continuously.

The finding from these observations is that a good diffusion of the various elements results in the formation of a solid solution between the superalloy C and the NiAl intermetallic material at the interface between these two materials.

In addition, the heat released by the exothermic reaction in the synthesis of the NiAl intermetallic compound is sufficient to affect the entire thickness of the sintered intermediate element 11 and to promote the diffusion of elements from the other side and the appearance of an interface between the superalloys C and B.

We claim:

1. A method of making a deposit on a component made of a nickel-based or cobalt-based superalloy, comprising the steps of:

(a) depositing on at least one localized region of the component, a material containing a mixture of powders in proportions which are reactive to form an intermetallic material containing aluminum and nickel or cobalt;

(b) placing the component bearing the material deposited in step (a) in a high-pressure chamber provided with means for feeding and compressing a neutral gas to obtain a neutral gas atmosphere in said chamber at a hydrostatic pressure of up to 1.5 GPa, heater means for achieving a temperature of up to 1200° C. in said chamber at a rate of increase of between 5° C. per minute and 120° C. per minute while ensuring a thermal gradient of 200° C. from one end to the other of said localized region of the component, and means for controlling temperatures in said chamber; and (c) operating said heater means and said neutral gas feeding and compressing means to obtain conditions of temperature and pressure in said chamber whereby the material deposited in step (a) undergoes a synthesis reaction by self-propagated combustion under high hydrostatic pressure of said neutral gas so as to obtain densification of the deposit and a metallurgical bonding between the deposit and the superalloy component in said localized region thereof.

2. A method according to claim 1, wherein said deposit constitutes a repair of said localized region of the component and surfaces of the component are finish-machined after cooling the component at the end of step (c).

3. A method according to claim 1, wherein said deposit forms a protective coating on at least one region of said component and increases the resistance of said region to oxidation, corrosion and/or erosion.

4. A method according to claim 1, wherein the final thickness of said deposit on said component is between 20 $\mu$m and 10 mm.

5. A method according to claim 1, wherein said material deposited in step (a) is a dense element which has been formed by a process comprising mixing suitable quantities of nickel and aluminum powders having a particle size smaller than 150 $\mu$m in equiatomic proportions, and cold compacting the mixture in a suitable mould under a load of 40 MPa.

6. A method according to claim 5, further comprising a step of placing a dense additional element on the surface of said component in said localized region to form a sublayer prior to depositing the material in step (a), said additional element having been obtained by sintering powders of nickel-based superalloy before depositing the material in step (a).

7. A method according to claim 6, wherein said component is made of a superalloy having the following nominal composition in weight percentages: Cr 14, Co 9.5, Mo 4, Al 3, W 4, Ti 5, Si 0.2, Mn 0.2, C 0.17; and Ni as the remainder; and said dense compact additional element forming said sub-layer has the following composition in weight percentages: Co from 16.5 to 19, Cr from 10.4 to 12.2, Mo from 3.3 to 4.2, Al from 2.85 to 3.15, Ti from 2.45 to 2.8, Si from 1 to 1.3, B from 0.68 to 0.8, C from 0 to 0.06; and Ni as the remainder.

* * * * *

UNITED STATES PATENT AND TRADEMARK OFFICE

CERTIFICATE OF CORRECTION

PATENT NO. : 5,954,895

DATED : September 21, 1999

INVENTOR(S): Marie-Caroline DUMEZ, ET AL.

It is certified that an error appears in the above-identified patent and that said Letters Patent is hereby corrected as shown below:

Column 8, line 36, "dense compact additional" should read --dense additional--.

Signed and Sealed this

First Day of May, 2001

*Attest:*

Nicholas P. Godici

NICHOLAS P. GODICI

*Attesting Officer*

*Acting Director of the United States Patent and Trademark Office*